US005144896A

United States Patent [19]

Fortsch

[11] Patent Number: 5,144,896

[45] Date of Patent: Sep. 8, 1992

[54] DEVICE FOR RECEIVING, GUIDING, PROTECTING, AND CONCEALING THE ELECTRIC POWER LEADS IN A PIECE OF FURNITURE SUPPORTING ELECTRIC AND ELECTRONIC APPLIANCES

[75] Inventor: Friedrich Fortsch, Strasbourg, France

[73] Assignee: Steelcase Strafor (S.A.), France

[21] Appl. No.: 620,551

[22] Filed: Dec. 3, 1990

[30] Foreign Application Priority Data

Dec. 1, 1989 [FR] France ..... 89 16085

[51] Int. Cl.[5] ..... A47C 35/00

[52] U.S. Cl. ..... 108/50; 312/223.6; 312/196; 108/26

[58] Field of Search ..... 108/50, 23, 26, 28, 108/30; 312/196, 223

[56] References Cited

U.S. PATENT DOCUMENTS

| | | | |
|---|---|---|---|
| 2,942,924 | 6/1960 | Stangert | 312/196 X |
| 3,635,174 | 1/1972 | Ball et al. | 108/50 X |
| 4,094,256 | 6/1978 | Hölper et al. | 108/50 |
| 4,155,310 | 5/1979 | Gregory | 108/26 |
| 4,163,867 | 8/1979 | Breidenbach | 312/223 X |
| 4,296,981 | 10/1981 | Hildebrandt et al. | 312/223 X |
| 4,372,629 | 2/1983 | Propst et al. | 312/196 X |
| 4,433,630 | 2/1984 | Laborie | 108/50 |
| 4,535,703 | 8/1985 | Henriott et al. | 312/223 X |
| 4,762,072 | 8/1988 | Boundy et al. | 108/50 |
| 4,838,175 | 6/1989 | Hauville | 108/50 X |

FOREIGN PATENT DOCUMENTS

| | | | |
|---|---|---|---|
| 1590188 | 6/1970 | Fed. Rep. of Germany | 312/223 |
| 2716941 | 10/1978 | Fed. Rep. of Germany | 312/223 |

*Primary Examiner*—Peter A. Aschenbrenner
*Attorney, Agent, or Firm*—Mason, Fenwick & Lawrence

[57] ABSTRACT

A frame for a modular piece of office furniture allows electrical cords of appliances on the top of the furniture to be connected to power through the frame at the closest point possible. Each modular element includes a metallic shaped tube 1 having a horizontal upper face 1*b* to be fixed to the top 2 of the furniture, a substantially vertical rear face 1*a* and an ornamental front face 1*c*. The upper face 1*b* and the front face 1*c* are spaced by a slot 3 under the edge of the top. All electrical power leads feeding appliances located on the top are received, guided and concealed in the shaped tube 1. The connection between each of the appliances and its corresponding power lead runs through the slot at the point located closest to the appliances. The modular elements may be assembled as a frame serving the multiple purposes of providing support for the top of the piece of furniture, as well as receiving, guiding, protecting, and concealing all the electrical power leads. Each of the modular elements is assembled with a next modular element through an angle bracket fixed to the rear faces 1*a* of the shaped tubes 1.

6 Claims, 5 Drawing Sheets

DEVICE FOR RECEIVING, GUIDING, PROTECTING, AND CONCEALING THE ELECTRIC POWER LEADS IN A PIECE OF FURNITURE SUPPORTING ELECTRIC AND ELECTRONIC APPLIANCES

BACKGROUND AND SUMMARY OF THE INVENTION

This invention relates to office furniture, and more specifically to "modular" furniture. Modular furniture comprises a limited number of standard units adapted to be assembled together to define furniture in shapes and dimensions corresponding to any need.

It relates more particularly to furniture which are designed in such a manner to provide means for receiving, guiding and concealing the power leads feeding all the appliances supported thereupon, said means having for further advantage to protect said power leads while allowing each of them to be available at a closest corresponding location, regardless of the location of the appliances.

Generally, a piece of furniture according to this invention comprises a top supported by a metallic frame having feet, and said power leads of said appliances distributed on said top are running from said appliances to their sockets usually at the ground level. As soon as several appliances are concerned. There appears an entanglement of leads, which is unpractical, inaesthetic and likely to damage appliances as well as leads.

To deal with this drawback, it has been proposed attachments provided in order to group together the sockets for leads connecting several appliances and looking like a dashboard installed for example on the wall above the piece of furniture having such appliances thereupon. However such an attachment is not a part of said piece and does not solve the problem of the leads running between the appliances and the sockets.

This invention solves this problem as well as those described herinabove, thanks to simple means requesting only small changes in the existing furniture, involving minor expenses and having no consequence in their use.

Said changes are essentially related to the shaping of the frame elements and of the feet of the furniture, with a view to have said elements and feet adapted to receive, guide, protect and conceal all said power leads of all appliances distributed on the top of said piece of furniture, whatever their number and wherever their location.

By the term "appliances " it is well understood that all and any appliances used in a modern office are concerned, i.e. writing machines, computers of any size, recorders of any type as well as telephones, lamps and other lightening systems and the same; as a consequence, the term "power leads" should be taken as having the widest meaning, including coaxial cables, high voltage cables, low voltage cables and the same.

To this effect, according to this invention, the frame of such a piece of furniture is built from standard metallic elements, each of which consisting in a metallic shaped tube having an horizontal upper face supporting the top of said piece, a substantially vertical rear face and a front face, said horizontal face and said front face being spaced by a slot opening under the edge of said top, all the power leads needed for feeding all the appliances located upon said top being received in said shaped tube and all the connections between all said appliances and said leads running from each appliance to the point of the corresponding led closest from said appliance.

Preferably, such a shaped tube has along one of its edges defining said slot a rim providing its stiffness.

The frame of the piece of furniture of the invention is therefore built from a number of such shaped tubes assembled together, e.g. by angle brackets which can be used to fixe to said pieces further attachments such as boxes, racks, shelves and the same.

The top is supported by said frame upon the horizontal faces of said elements, and preferably a rubber lip is pinched between said top and said element in such a manner to cover said slot to conceal and protect the same, which allows the passage of all leads at any location of said slot. As a consequence thereof, when an appliance is disposed in a given location upon said top, it will only be necessary to run its power feeding lead perpendicular to the top edge until the corresponding point of the sot, and to pass it through the slot by distorting temporarily said lip then along the shaped tube until its socket.

Generally said sockets are at the ground level so that the invention provides also means for guiding and protecting the leads from the frame until the ground. Such means consist in a specific construction of the feet of the piece of furniture.

According to this invention, a foot comprises a metallic shaped tube having two vertical rear faces having the width of a frame element, and cut out at their top corresponding to the opening of said frame elements, and one front face set back from said rear faces front edge, the remaining space in front of said front element being closed by a cover defining at tis top part a channel for said power leads passing from an element to another, said channel opening at its end in front of said cuts, and further defining along its height a vertical channel for receiving, guiding and concealing said leads from said top to the ground socket.

Preferably, such a shaped tube is obtained by simple shaping of a unique sheet and fitting of the cover by any proper means, which gives a possibility, according to the selection of the cover, to offer quite a variety of decorations for the piece of furniture.

According to a modification, instead of a unique sheet, the same tube can be obtained form two shaped sheets assembled along their vertical edges.

It is therefore clear that this invention provides a new piece of furniture which is distinctively original in relation to the previously known, by the construction of the frame elements and of the feet, obtained as simple shaped tubes of proper section, said construction having for advantage to provide for all needed power leads reception, guidance, protection and concealing from all appliances to their ground sockets.

BRIEF DESCRIPTION OF THE DRAWINGS

This invention will now be described with reference to the attached drawing on which.

DETAILED DESCRIPTION OF THE PREFERRED EMBODIMENTS

Figure 1:
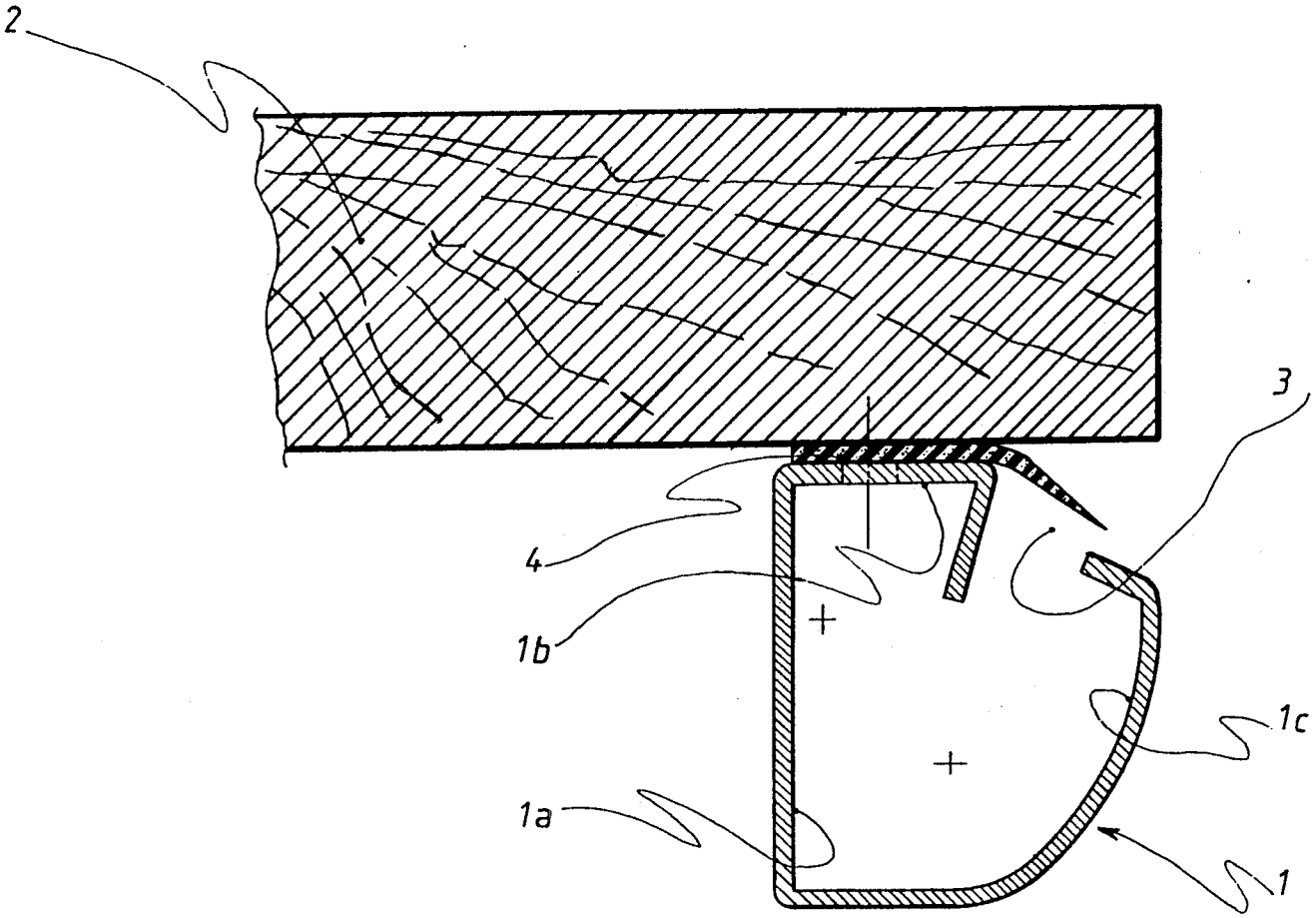
FIG. 1 is a vertical section of a frame element of the invention fixed under a piece of furniture top.

As shown of FIG. 1, the shaped tube 1 forming one of the elements of the frame supporting the table top 2 comprises a rear vertical face 1*a*, an upper horizontal face i*b* and a front 1*c* having a decoration design, a longitudinal space 3 being provided therebetween.

The top 2 is fixed upon said tube 1 in a manner to cover said space. Preferably a rubber lip 4 is pinched between the top 2 and the face 1*b* of the tube 1 in order to hide the space 3 which allows a passage for laterally insert the power leads.

Figure 2:
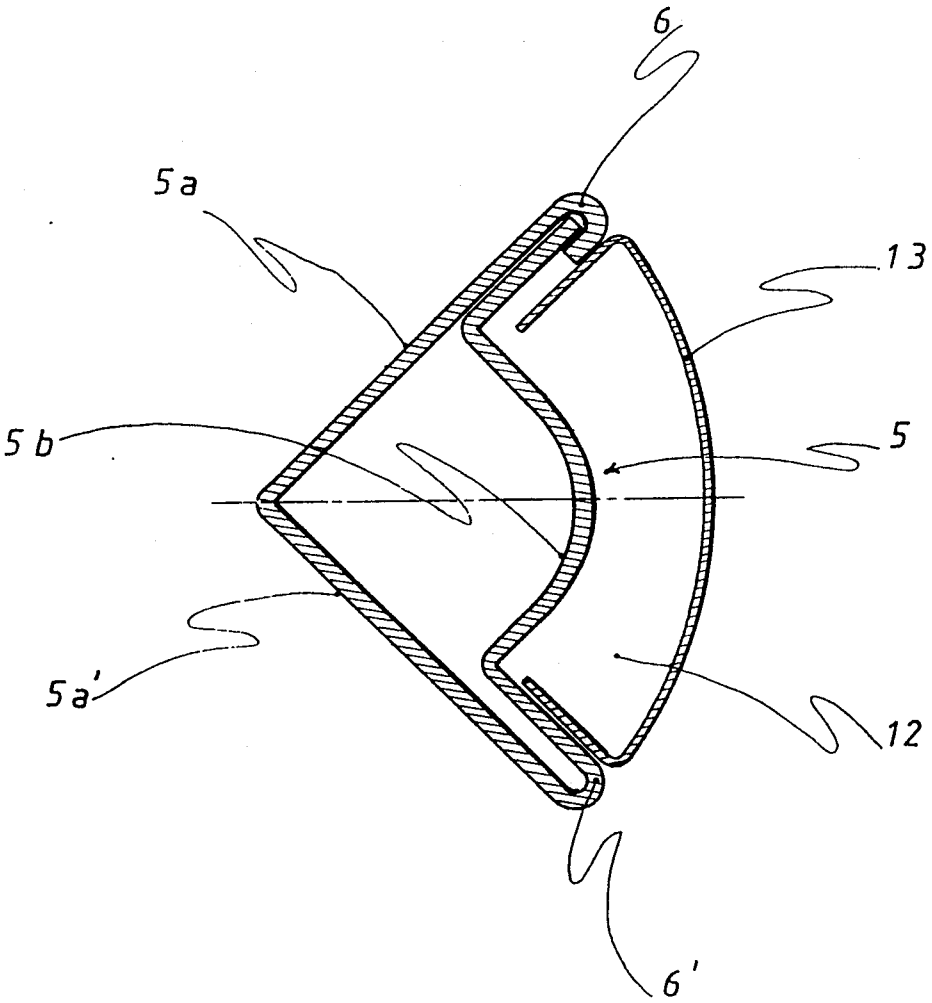
FIG. 2 is an horizontal section of a foot of the invention, with its cover element.

Referring now to FIG. 2, it is shown a shaped tube 5, which is the mechanically strong part of the feet, and having a couple of rear faces 5*a*—5*a* ', and a front face 5*b*, set back from the edges of faces 5*a*—5*a*', such a shape being obtained by knurling of the wings 6—6' or simply shaping of a unique sheet as shown.

Figure 3:
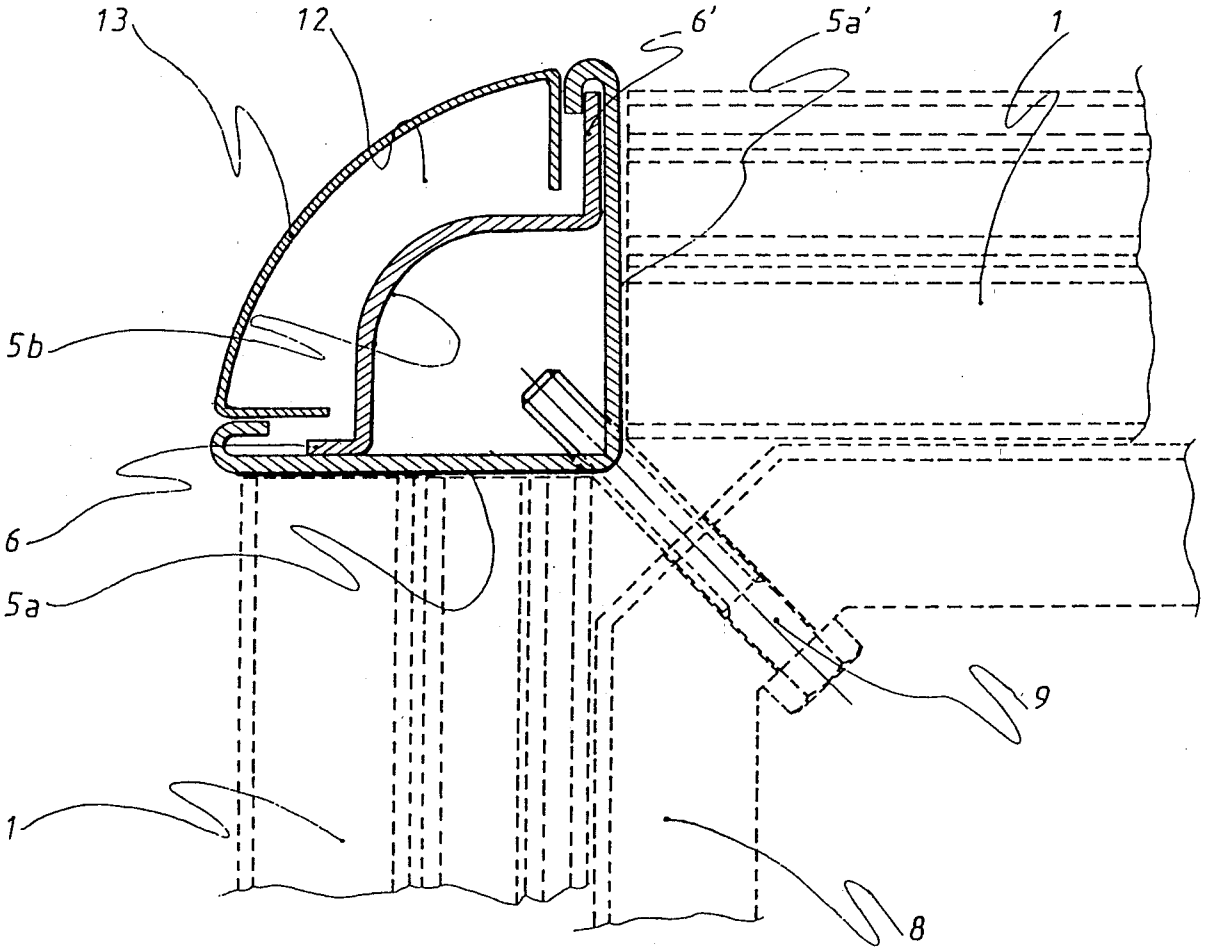
FIG. 3 is also an horizontal section of a foot of the invention, placed in an angle of a frame of the invention.
Figure 4:
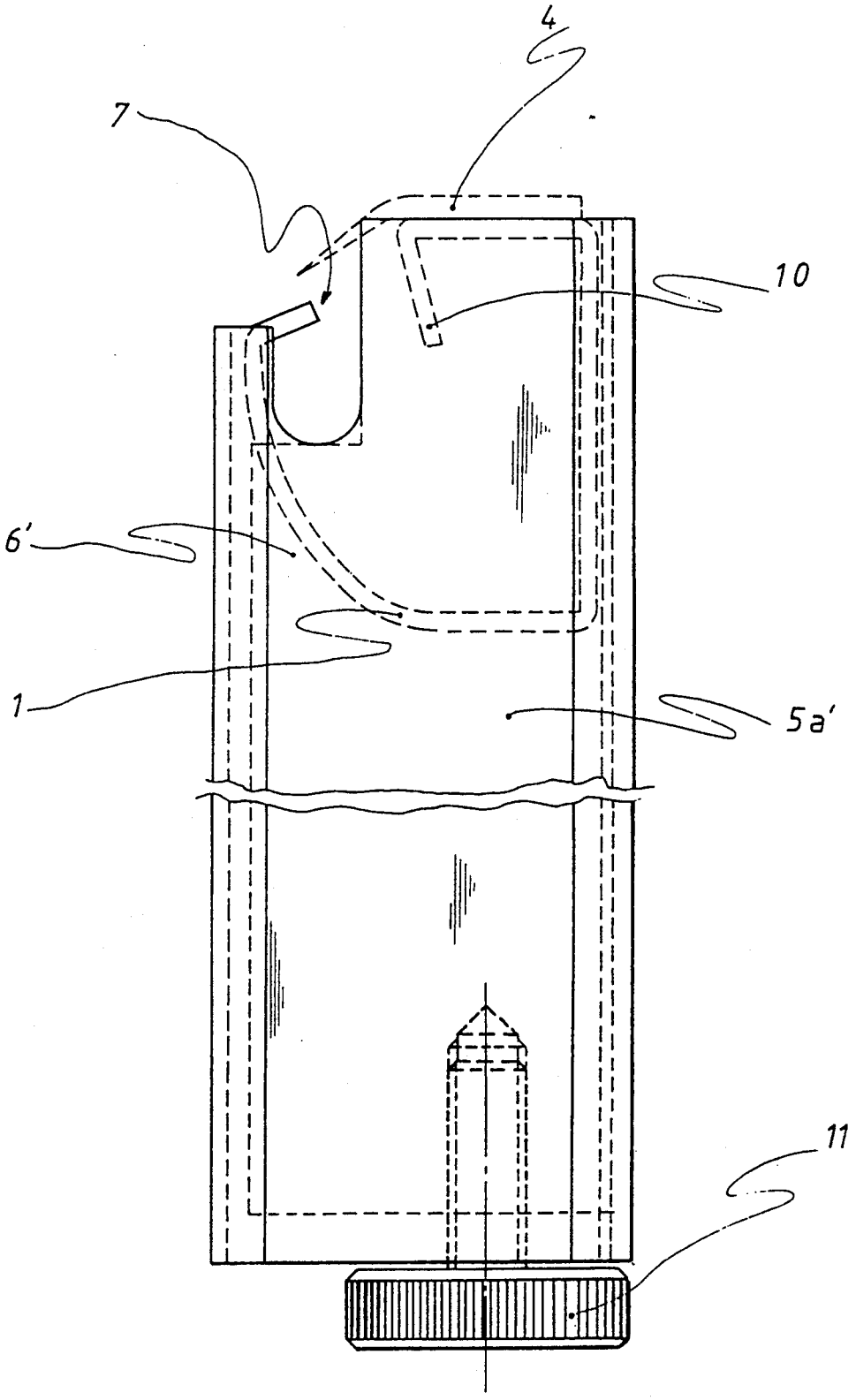
FIG. 4 is a vertical section along IV—IV of FIG. 3.

As shown on the drawing, and more specially on FIGS. 3 and 4, wings 6—6' of the faces 5*a*—5*a*' are cut out as in 7—7' in such a manner than said cuts are facing the space 3 of tubes 1 when the frame is assembled to a foot, as shown on FIG. 3.

On FIG. 3 is also shown the assembly of tubes 1 together through a corner bracket 8, and the fixing of foot 5 is obtained by a diagonal bolt 9.

The stiffness of tube 1 is improved by a curved rim 10 along the edge of face 1*b*, and the foot comprises an height adjustment screw 11.

The shape of the tube 5 with its wings 6 defines an empty space 12 which is covered by a cover 13 fitted to the foot by any proper means and having a double purpose to close space 12 and to provide a decorative element for the foot.

Figure 5:
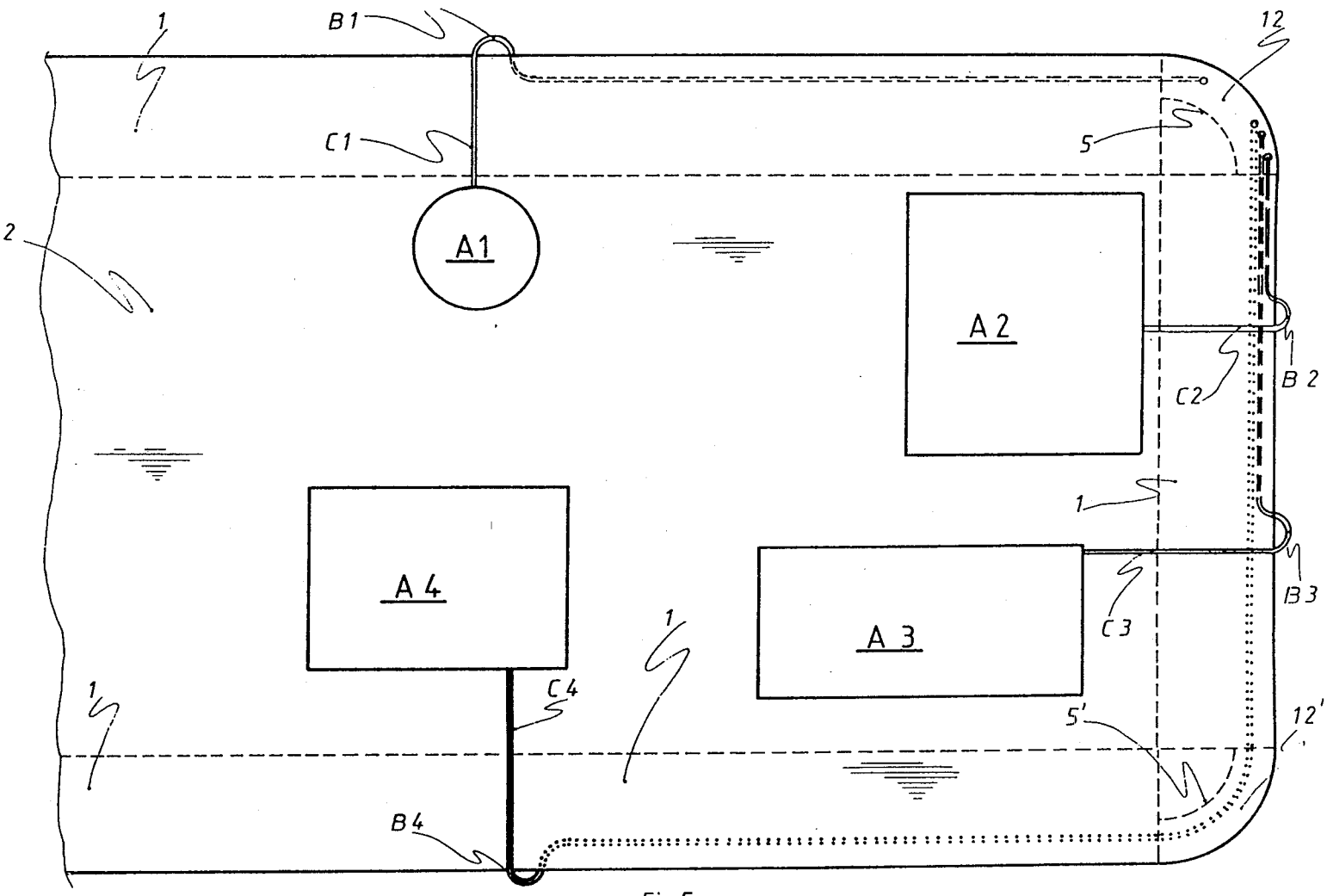
FIG. 5 is a sketch showing the use of the invention with a number of appliances on the top of a table.

A piece of furniture of the above described type has for advantage to provide a top upon which all needed appliances and accessories at any proper location, as shown by FIG. 5, on which appliances $A_1$, $A_2$, $A_3$ are properly distributed on the top 2 and fed by power leads $C_1$, $C_2$, $C_3$.

In an ordinary installation, said leads would simply freely run on the table 2 before running downwardly to their socket, with a chance to entangle and to damage the appliances in case of accidental pull.

On the contrary, with the system of the invention, each of the leads $C_1$, $C_2$, $C_3$ appears on the table 2 only between the corresponding appliances $A_1$, $A_2A_3$ and the closest point of the top edge $B_1$, $B_2$, $B_3$ where it runs into the tube 1 in which it is horizontally guided to the space 12 of the feet 5 in which it runs downwardly until the socket in the ground.

When a fourth appliance $A_4$ is installed in the opposite area of the top 2, the corresponding lead $C_4$ runs on the top until it reaches the opposite edge and from this point, it runs successively along two successive tubes 1, being guided therebetween by the space 12' of the feet 5', to reach finally the feet 5 and the ground socket.

It is well understood that whereas this system is adapted to a simple rectangular top as shown by the illustrative example, it can be modified to all possible modular combinations of any number of units, the horizontal tubes being connected in line one to the other.

Particularly, insofar each foot can be used for a lead being guided until the ground, it allows a separation of the individual leads if this is required by the user or by the local regulations regarding the power leads under various tensions.

What is claimed is claim:

1. A frame for a piece of furniture having a generally horizontal furniture top adapted to receive thereon a number of electrical appliances having respective power lines, the frame comprising:

at least one section, each section including a substantially horizontal top face, a substantially vertical rear face and a front face, the top face connected to the rear face and the rear face connected to the front face, the front face extending upward toward the top face to form therebetween a continuous horizontal longitudinal slot for passing the power lines, each section defining an interior channel dimensioned for guiding, protecting and concealing the power lines between the top face, rear face and front face; and at least one leg, connected to the section and extending downward therefrom, which leg provides support for the frame and furniture top, at least one of the legs including a metallic shaped tube which has a leg front face which forms part of a leg channel extending to the bottom of the frame.

2. The frame of claim 1, wherein:

a) the shaped tube includes two planar rear faces connected to each other, each planar rear face having a width substantially the same as a width of the frame section and having at a top part of each planar rear face a cut facing a frame section;

b) the leg front face is set back from front edges of the rear faces and is connected to at least one of the two rear faces; and c) the frame further comprises a cover which is connected to at least one of the two planar rear faces or the leg front face, to define the leg channel in front of the leg front face of the shaped tube, the leg channel dimensioned to receive, guide and conceal the lines, the cover also defining at its top part a horizontal channel dimensioned to pass the power lines from one section to a next section, the horizontal channel having end openings in front of the cuts.

3. The frame of claim 1, further comprising:

a bracket affixed to the rear face of the section; and a diagonal bolt connected to the leg and to the bracket, and fixing the leg to the bracket so as to provide stiffness to the assembled leg and section.

4. The frame of claim 1, wherein:

each leg comprises a single sheet of shaped material.

5. The frame of claim 1, wherein:

each leg includes an assembly of two shaped tubes.

6. A frame for a piece of furniture having a generally horizontal furniture top adapted to receive thereon a number of electrical appliances having respective power lines, the frame comprising:

at least one section, each section including a substantially horizontal top face, a substantially vertical rear face and a front face, the top face connected to the rear face and the rear face connected to the front face, the front face extending upward toward the top face to rom therebetween a continuous horizontal longitudinal slot for passing the power lines, each section defining an interior channel dimensioned for guiding, protecting and concealing the power lines between the top face, rear face and front face; and a lip positioned with respect to the top face to yieldingly conceal the slot while allowing passage of the power lines through the slot.

* * * * *